US008757763B2

(12) United States Patent
Hiwada

(10) Patent No.: US 8,757,763 B2
(45) Date of Patent: Jun. 24, 2014

(54) METHOD FOR MANUFACTURING LIQUID-JETTING HEAD AND LIQUID-JETTING HEAD

(75) Inventor: Shuhei Hiwada, Toyoake (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/294,264

(22) Filed: Nov. 11, 2011

(65) Prior Publication Data

US 2012/0133711 A1 May 31, 2012

(30) Foreign Application Priority Data

Nov. 30, 2010 (JP) ..... 2010-267669

(51) Int. Cl.
*B41J 2/015* (2006.01)

(52) U.S. Cl.
USPC ..... 347/20

(58) Field of Classification Search
None
See application file for complete search history.

(56) References Cited

U.S. PATENT DOCUMENTS

| | | | | |
|---|---|---|---|---|
| 2005/0030349 | A1 | 2/2005 | Taira | |
| 2005/0168536 | A1* | 8/2005 | Katayama | 347/70 |
| 2007/0143985 | A1* | 6/2007 | Sano et al. | 29/603.01 |
| 2011/0074886 | A1 | 3/2011 | Kubo | |

FOREIGN PATENT DOCUMENTS

| | | |
|---|---|---|
| JP | 2005-22129 | 1/2005 |
| JP | 2005-238839 | 9/2005 |
| JP | 2005-262445 | 9/2005 |
| JP | 2006-248112 | 9/2006 |
| JP | 2011-073244 | 1/2011 |

OTHER PUBLICATIONS

Notice of Reasons for Rejection of Japanese Application No. 2010-267669 dated Dec. 17, 2013.

* cited by examiner

*Primary Examiner* — Matthew Luu
*Assistant Examiner* — Erica Lin
(74) *Attorney, Agent, or Firm* — Frommer Lawrence & Haug LLP

(57) ABSTRACT

A method for manufacturing a liquid-jetting head includes: providing a flow passage unit in which a plurality of jetting ports and a plurality of individual liquid flow passages are formed; providing a plurality of actuator units which are arranged to be adjacent to each other on a surface of the flow passage unit and each of which includes a plurality of actuators having individual electrodes corresponding to the individual liquid flow passages; providing a drive circuit for each of the actuator units which supplies a drive signal to each of the actuators; providing a plurality of wiring members each of which is fixed on one of the actuator units to electrically connect the actuator unit and the drive circuit; folding base materials of the wiring members; and joining the base materials to the actuator units after folding the base materials.

20 Claims, 10 Drawing Sheets

IXC
IXF
IXI
IXK
50x
50y
50p
51
51x
51y
51a
54
55
56
57
60
10a
12
12x
17
17r

METHOD FOR MANUFACTURING LIQUID-JETTING HEAD AND LIQUID-JETTING HEAD

CROSS REFERENCE TO RELATED APPLICATION

The present application claims priority from Japanese Patent Application No. 2010-267669, filed on Nov. 30, 2010, the disclosure of which is incorporated herein by reference in its entirety.

BACKGROUND OF THE INVENTION

1. Field of the Invention

The present invention relates to a liquid jetting head which jets liquids such as inks and the like, and a method for manufacturing the same.

2. Description of the Related Art

As disclosed in Japanese Patent Application Laid-Open No. 2006-248112, a configuration, of the ink-jet head as an example of the liquid-jetting head, in which an actuator unit (a vibration plate and a piezoelectric element of a head unit 12) and a drive circuit (a switch IC 28 for supplying a drive signal to the piezoelectric element) are electrically connected by a wiring member (the electric wires 26), is known. The wiring member generally includes a plurality of contact points to be connected to individual electrodes of actuators (electrode pads formed on piezoelectric elements), a plurality of wires electrically connected with the contact points respectively, and a base material on which the contact points and the wires are formed.

And now, in order, to realize high-speed recording and high-quality printing, it is desired that a large number of jetting ports are arranged in an ink-jet head. As the number of the jetting ports increases, the number of wires also increases. In such cases, for reasons of the wire arrangement and the like, with respect to each wiring member, the base material may have to be increased in number or size, the direction of drawing out wires may have to be changed, etc.

In the configuration of arranging a plurality of actuator units adjacent to each other as disclosed in Japanese Patent Application Laid-Open No. 2006-248112, increasing the number of wires as described above may cause the base material of a wiring member to overlap another actuator unit different from the actuator unit corresponding to the base material of the wiring member. This makes it difficult to carry out a joining process for joining the actuator unit and the wiring member.

SUMMARY OF THE INVENTION

To address the above problem, an object of the present invention is to provide a liquid jetting head and a method for manufacturing the same with which it is possible to easily carry out the joining process of joining the actuator unit and the wiring member even if a part of the wiring member overlaps with another actuator unit different from the actuator unit corresponding to the base material of the wiring member in an unfolded state of the wiring member.

According to a first aspect of the present teaching, there is provided a method for manufacturing a liquid-jetting head which jets a liquid, including: providing a flow passage unit in which a plurality of jetting ports from which the liquid is jetted and a plurality of individual liquid flow passages which are connected to the jetting ports respectively are formed; providing a plurality of actuator units, which are arranged to be adjacent to each other on a surface of the flow passage unit, each of which includes a plurality of actuators having individual electrodes each corresponding to one of the individual liquid flow passages, and each of which imparts a jetting energy to the liquid in the individual liquid flow passages by driving the actuators; providing a drive circuit, for each of the actuator units, which supplies drive signals to the actuators; providing a plurality of wiring members each of which is fixed on one of the actuator units to electrically connect the one of the actuator units and the drive circuit, and each of which includes: a plurality of contact points to be connected to the individual electrodes of the actuators; a plurality of wires connected to the contact points respectively; and a base material on which the contact points and the wires are formed, the base material having a first region in which the plurality of contact points are formed and which faces one actuator unit among the actuator units and a second region which is different from the first region and in which the contact points are not formed, and the base material being configured such that at least a part of the second region overlaps with another actuator unit adjacent to the one actuator unit in a first direction perpendicular to the surface of the flow passage unit in a state that the base material is unfolded to be parallel to the surface of the flow passage unit; folding the base material such that the second region does not overlap with the another actuator unit in the first direction in a state that the first region faces the one actuator unit; and joining the contact points of the base material respectively to the individual electrodes of the one actuator unit in a state that the first region faces the one actuator unit after folding the base material.

According to a second aspect of the present teaching, there is provided a liquid-jetting head which jets a liquid, including: a flow passage unit in which a plurality of jetting ports from which the liquid is jetted and a plurality of individual liquid flow passages which are connected to the jetting ports respectively are formed; a plurality of actuator units, which are arranged to be adjacent to each other on a surface of the flow passage unit, each of which includes a plurality of actuators having individual electrodes each corresponding to one of the individual liquid flow passages, and each of which imparts a jetting energy to the liquid in the individual liquid flow passages by driving the actuators; a drive circuit, for each of the actuator units, which supplies drive signals to the actuators; a plurality of wiring members each of which is fixed on one of the actuator units to electrically connect the one of the actuator units and the drive circuit, wherein each of the wiring members includes a plurality of contact points to be connected to the individual electrodes of the actuators, a plurality of wires connected to the contact points respectively, and a base material on which the contact points and the wires are formed, the base material has a first region in which the plurality of contact points are formed and which faces one actuator unit among the actuator units and a second region which is different from the first region and in which the contact points are not formed, and the base material is configured such that at least a part of the second region overlaps with another actuator unit adjacent to the one actuator unit in a first direction perpendicular to the surface of the flow passage unit in a state that the base material is unfolded to be parallel to the surface.

According to the above first and second aspects, it is possible to easily carry out the joining of the base material and the actuator unit even if the base material in an unfolded state overlaps another actuator unit.

DESCRIPTION OF THE PREFERRED EMBODIMENT

Figure 1:
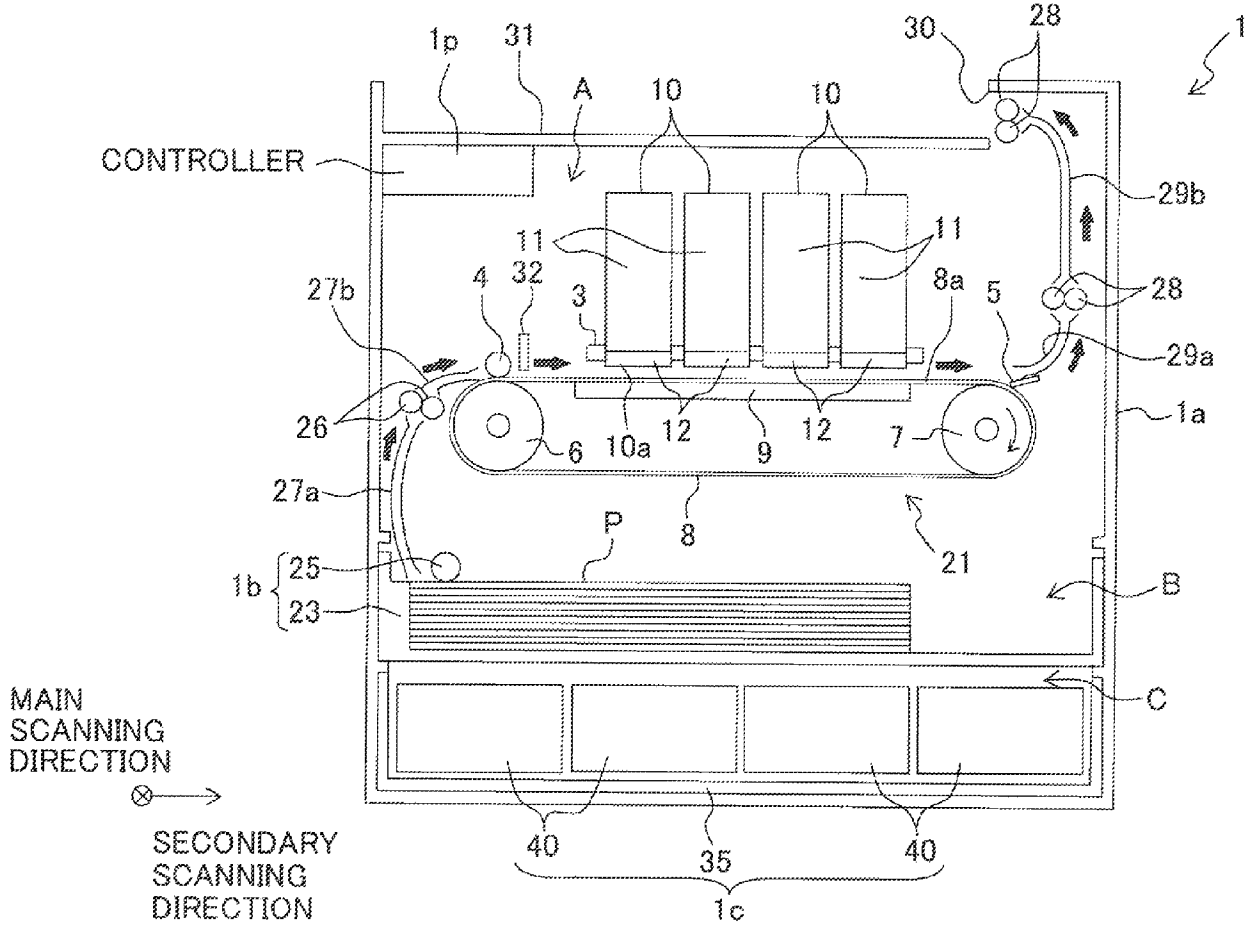
FIG. 1 is a schematic side view showing an internal structure of an ink-jet printer to which an ink-jet head in accordance with an embodiment of the present teaching is applied.

Hereinbelow, referring to the accompanying drawings, a preferred embodiment of the present invention will be explained.

First, referring to FIG. 1, explanations will be made with respect to an overall construction of an ink-jet printer 1 to which ink-jet heads 10 in accordance with the embodiment of the present teaching is applied.

The printer 1 has a box-shaped casing 1*a*. A paper discharge section 31 is provided at the upper side of the top panel of the casing 1*a*. The inner space of the casing 1*a* can be divided into a space A, a space B and a space C in sequence from above. The spaces A and B are spaces in which a paper transport path in connection with the paper discharge section 31 is formed. In the space A, a sheet of paper P is transported and some image is recorded on the paper P. In the space B, an operation is carried out with respect to paper feeding. In the space C, ink cartridges 40 as ink supply sources are accommodated.

In the space A, there are arranged four ink jet heads 10, a transport unit 21 for transporting the paper P, a guide unit (to be described later) for guiding the paper P, and the like. In the upper portion of the space A, a controller 1*p* is arranged to govern the operation of the whole printer 1 by controlling the operation of each section of the printer 1 including those mechanisms described above.

The controller 1*p* controls a preparatory operation for recording, operations of supplying, transporting and discharging the paper P, an ink jetting operation synchronized with transporting of the paper P, an operation for restoring and maintaining the jetting performance (maintenance operation), and the like, so as to record the image on the paper P based on an image data supplied from an external device and the like.

The controller 1*p* has a CPU (Central Processing Unit) which is a computation processing device. In addition to that, it has a ROM (Read Only Memory), a RAM (Random Access Memory, including nonvolatile RAM), an ASIC (Application Specific Integrated Circuit), an I/F (Interface), an I/O (Input/Output Port), and the like. The ROM stores programs to be executed by the CPU, various fixed data, and the like. The RAM temporarily stores data needed for executing the programs (image data, for example). The ASIC carries out rewriting, sorting and the like for the image data (signal processing and image processing). The I/F carries out data transmission and data reception with the external device and the like. The I/O carries out input/output of the detection signals of various sensors.

Each ink-jet head 10 is a line head having an approximately boxed-shape elongated in a main scanning direction. The four ink jetheads 10 are aligned at predetermined intervals in a secondary scanning direction, and supported on the casing la via a head frame 3. Here, the secondary scanning direction refers to transport direction of the paper P by the transport unit 21, while the main scanning direction is parallel to the horizontal plane and perpendicular to the secondary scanning direction. Each ink jet head 10 includes a flow passage unit 12, eight actuator units 17 (see FIG. 2), and a reservoir unit 11. At the time of image recording, inks of magenta, cyan, yellow and black are jetted from the lower surfaces of the four ink jet heads 10 (jetting surfaces 10*a*), respectively. A more concrete configuration of the ink-jet head 10 will be described in detail hereinafter.

As shown in FIG. 1, the transport unit 21 has belt rollers 6 and 7, and an endless transport belt 8 stretched between the two belt rollers 6 and 7. In addition to these components, the transport unit 21 also has a nip roller 4 and a detachment plate 5 which are arranged at the outer side of the transport belt 8, a platen 9 arranged at the inner side of the transport belt 8, and the like.

The belt roller 7 is a driving roller, which is driven by a transport motor (not shown) to rotate clockwise in FIG. 1. Along with the rotation of the belt roller 7, the transport belt 8 travels along the thick arrows in FIG. 1. The belt roller 6 is a driven roller, which rotates clockwise in FIG. 1 along with the travel of the transport belt 8. The nip roller 4 is arranged to face the belt roller 6 to press the paper P supplied from an upstream guide section (to be described later) against an outer circumferential surface 8*a* of the transport belt 8. The detachment plate 5 is arranged to face the belt roller 7 to detach the paper P from the outer circumferential surface 8*a* and guide the paper P to a downstream guide section (to be described later). The platen 9 is arranged to face the four ink-jet heads 10 to support the upper loop of the transport belt 8 from the inner side. By virtue of this configuration, a predetermined interspace suitable for image recording is formed between the outer circumferential surface 8*a* and the jetting surfaces 10*a* of the ink-jet heads 10.

The guide unit includes the upstream guide section and the downstream guide section which are arranged to sandwich the transport unit 21 therebetween. The upstream guide section has two guides 27*a* and 27*b*, and a pair of delivery rollers 26. The upstream guide section connects a paper feed unit 1*b* (to be described later) and the transport unit 21. The downstream guide section has two guides 29*a* and 29*b*, and two pairs of delivery rollers 28. The downstream guide section connects the transport unit 21 and the paper discharge section 31.

In the space B, the paper feed unit 1*b* is arranged. The paper feed unit 1*b* to include a paper feed tray 23 and a paper feed roller 25, and the paper feed tray 23 is detachable from the casing 1*a*. The paper feed tray 23 is a box opening at the upper side, and can accommodate the paper P in various sizes. The paper feed roller 25 sends out the uppermost sheet of the paper P in the paper feed tray 23 to supply the paper P to the upstream guide section.

As described hereinabove, in the spaces A and B, the paper transport path is formed from the paper feed unit 1*b* up to the paper discharge section 31 through the transport unit 21. Based on a recording command, the controller 1*p* drives a paper feeding motor (not shown) for the paper feed roller 25, a delivery motor (not shown) for the delivery roller of each guide section, the transport motor, and the like. The paper P sent out from the paper feed tray 23 is supplied to the transport unit 21 by the delivery rollers 26. When the paper P passes through right under each ink-jet head 10 in the secondary scanning direction, inks are jetted in sequence from the jetting surfaces 10*a*, respectively, to record a color image on the paper P. The ink jetting operation is carried out based on a detection signal from a paper sensor 32. The paper P is then detached from the outer circumferential surface 8*a* of the transport belt 8 by the detachment plate 5 and transported upward by the two pairs of delivery rollers 28. Further, the paper P is discharged from an opening 30 at the upper side to the paper discharge section 31.

In the space C, an ink unit 1*c* is arranged to be detachable from the casing 1*a*. The ink unit 1*c* has a cartridge tray 35 and the four ink cartridges 40 accommodated side by side in the cartridge tray 35. Each ink cartridge 40 supplies an ink to the corresponding ink-jet head 10 via an ink tube (not shown).

Figure 2:
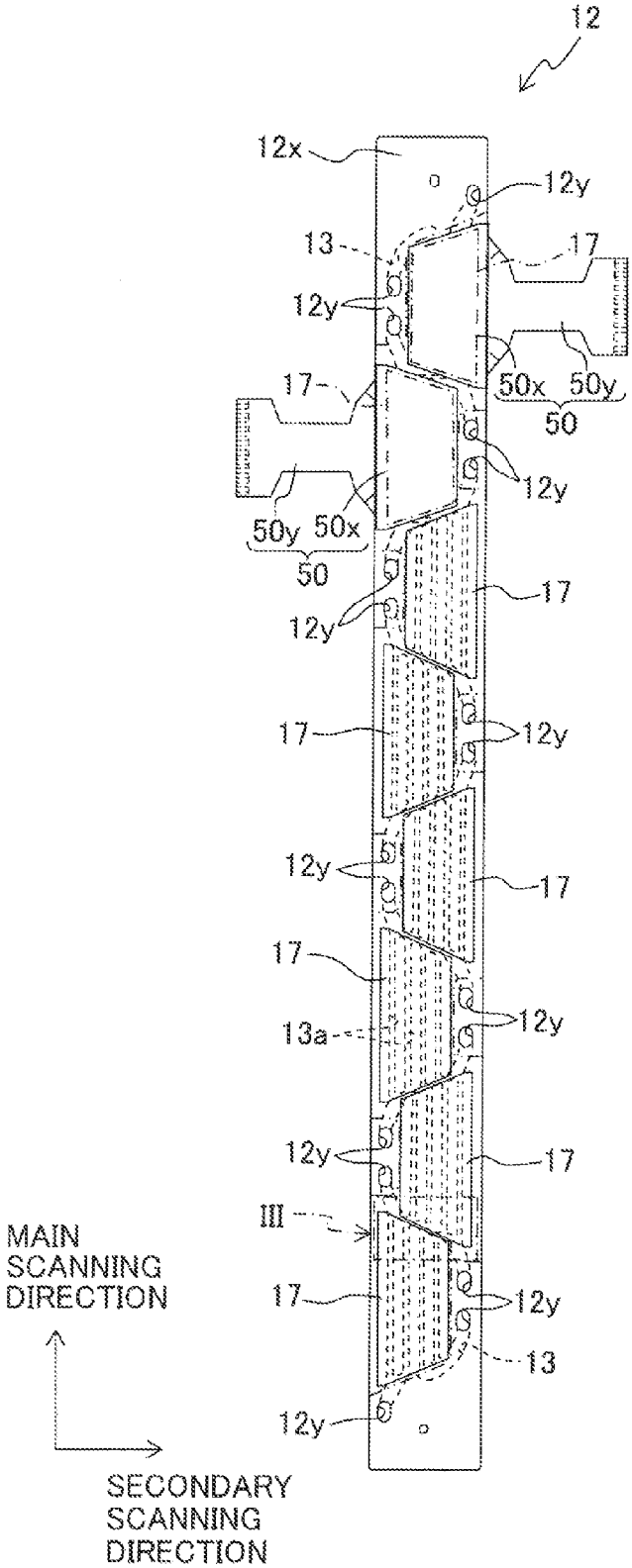
FIG. 2 is a plan view showing a flow passage unit and actuator units of the ink-jet head.
Figure 3:
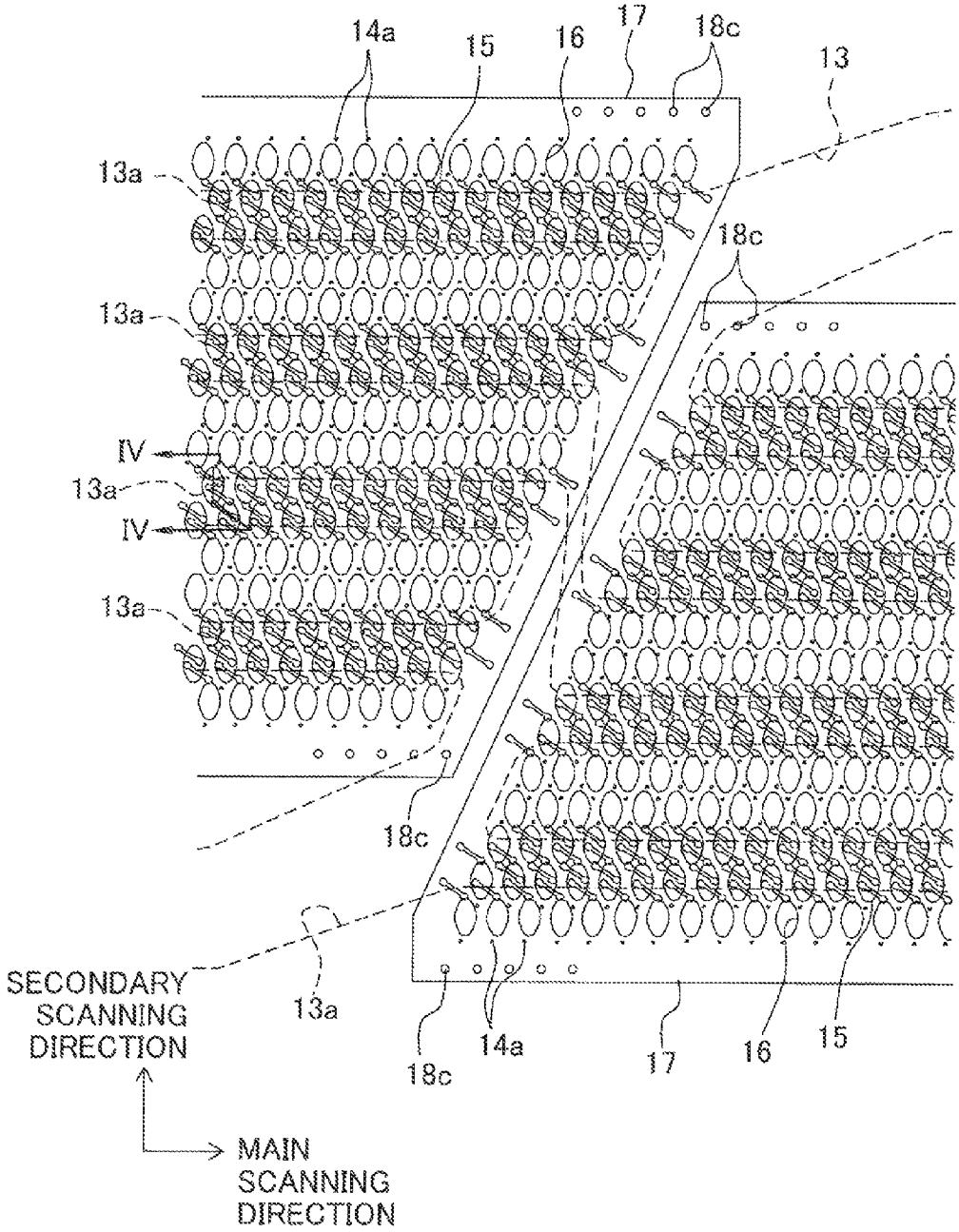
FIG. 3 is an enlarged view showing the region III surrounded by chain line in FIG. 2.

Next, referring to FIGS. 2 to 5, the configuration of the ink-jet head 10 will be explained in more detail. Further, to simplify matters, FIG. 2 shows only two wiring modules 50 corresponding to the actuator units 17. FIG. 3 shows pressure chambers 16 and apertures 15 below the actuator units 17 with solid lines which should have been dotted lines.

Figure 5:
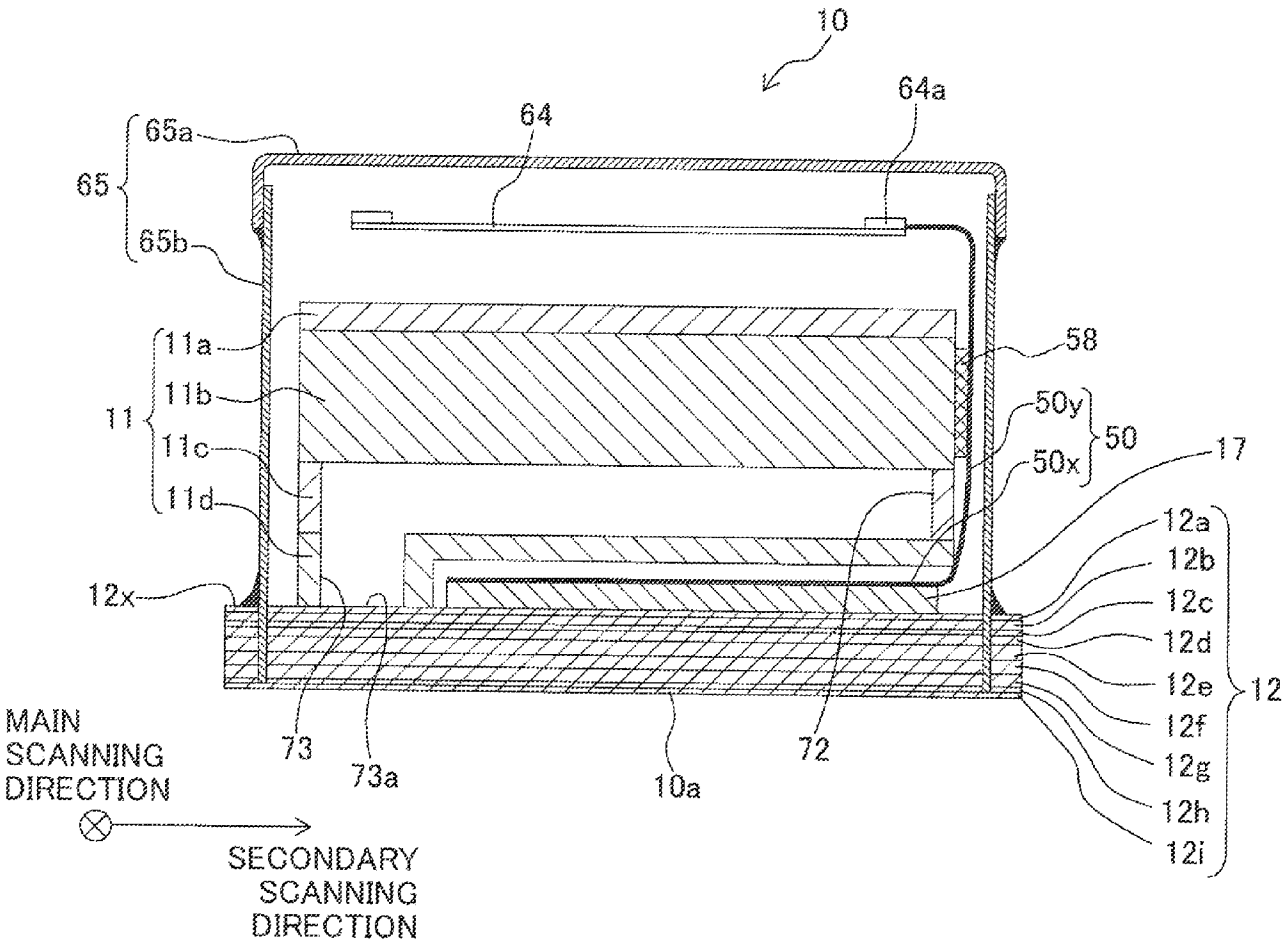
FIG. 5 is a longitudinal sectional view of the ink jet head.

As shown in FIG. 5, the ink-jet head 10 is a stacked body of stacking the flow passage unit 12, the actuator unit 17, the reservoir unit 11, and a substrate 64. Among these components, the actuator unit 17, the reservoir unit 11, and the substrate 64 are contained in a space formed by an upper surface 12*x* of the flow passage unit 12, and a cover 65. Inside this space, the wiring module 50 is electrically connected with the actuator unit 17 and the substrate 64.

The wiring module 50 is provided for each actuator unit 17, and configured by connecting a COF (Chip On Film) 50*x* and an FPC (Flexible Printed Circuit) 50*y*. The COF 50*x* is arranged to face the actuator unit 17. The FPC 50*y* is arranged to be lateral to the reservoir unit 11, and fixed to a lateral side of the reservoir unit 11 via an elastic and heat insulating sponge 58. One end of the FPC 50*y* is connected to the COF 50*x*, and the other end is connected to the substrate 64 via a connector 64*a*.

The cover 65 includes a top cover 65*a* and an aluminum side cover 65*b*. The cover 65 is a box opening at the lower side, and is fixed to the upper surface 12*x* of the flow passage unit 12.

The reservoir unit 11 is also a stacked body composed by adhering four metallic plates 11*a*, 11*b*, 11*c* and 11*d* each other. Inside the reservoir unit 11, an ink flow passage which includes a reservoir 72 for temporarily storing the ink supplied from the ink cartridge 40 is formed. One end of the ink flow passage is connected to the ink cartridge 40 via a tube and the like, and the other end is connected to the flow passage unit 12. The lower surface of the plate 11*d* is formed with a recess and a protrusion and a space is defined between the plate 11*d* and the upper surface 12*x* by the recess. The actuator unit 17 is fixed on the upper surface 12*x* inside the space, leaving a little space above the COF 50*x*. In the plate 11*d*, an ink outflow passage 73 is formed to open on a tip surface of the protrusion (that is, the joint surface with the upper surface 12*x*).

Figure 4:
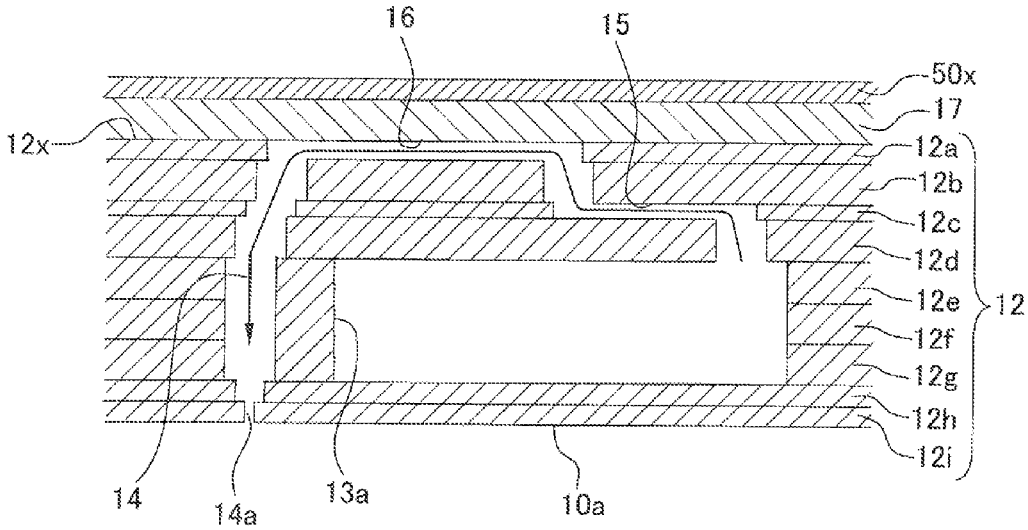
FIG. 4 is a partial cross-sectional view taken along the line IV-IV of FIG. 3.

The flow passage unit 12 is a stacked body composed by adhering nine metallic plates 12*a*, 12*b*, 12*c*, 12*d*, 12*e*, 12*f*, 12*g*, 12*h* and 12*i* each other. These are rectangular plates of almost the same size. As shown in FIG. 2, openings 12*y* are formed in the upper surface 12*x* of the flow passage unit 12. The openings 12*y* are connected to openings 73*a* of the ink outflow passages 73, respectively (see FIG. 5). Inside the flow passage unit 12, ink flow passages are formed from the openings 12*y* to jetting ports 14*a* (see FIG. 4). As shown in FIGS. 2 to 4, the ink flow passage includes a manifold flow passage 13 having the opening 12*y* at one end, a secondary manifold flow passage 13*a* branching from the manifold flow passage 13, and an individual flow passage 14 from the exit of the secondary manifold flow passage 13*a* through the pressure chamber 16 down to the jetting port 14*a*.

The individual flow passage 14 is formed for each jetting port 14*a* and, as shown in FIG. 4, includes the aperture 15 functioning as a throttle mechanism for adjusting the resistance in the flow passage, and the pressure chamber 16 opening on the upper surface 12*x*. As shown in FIG. 3, the pressure chambers 16 are approximately rhombic, respectively, and are arranged in a matrix form on the upper surface 12*x* to constitute totally eight pressure chamber groups occupying an approximately trapezoidal region in planar view (as viewed from a direction perpendicular to the upper surface 12*x*; the same is true hereinafter). The jetting ports 14*a* are, in the same manner as the pressure chambers 16, arranged in a matrix form on the jetting surface 10*a* to constitute totally eight jetting port groups occupying another approximately trapezoidal region in planar view. Each of the pressure chamber groups corresponds individually to one of the jetting port groups and, in planar view, one pressure chamber group overlaps with one jetting port group.

As shown in FIG. 2, the actuator units 17 each have a trapezoidal planar shape, and are arranged to be adjacent to each other on the upper surface 12*x* to align in two rows of a zigzag pattern. Each actuator unit 17 is, as shown in FIG. 3, arranged over the trapezoidal region occupied by the pressure chamber group (jetting port group).

Next, referring to FIGS. 6A and 6B, explanations will be made with respect to the configurations of the actuator unit 17 and the COF 50*x*.

Figure 6A:
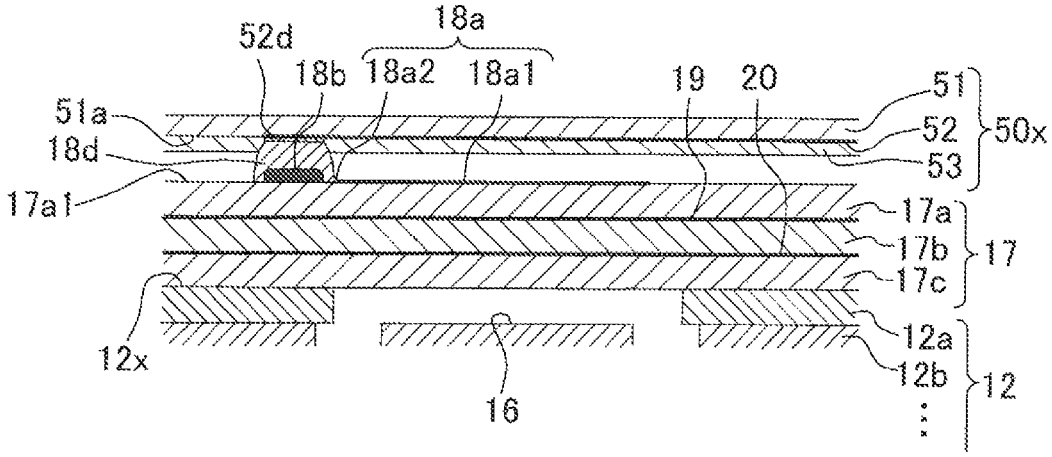
FIG. 6A is a partial cross-sectional view of the flow passage unit, an actuator unit, and a COF.
Figure 6B:
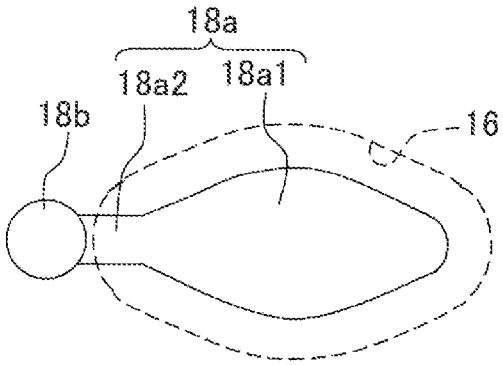
FIG. 6B is a plan view showing an individual electrode of the actuator unit.

As shown in FIG. 6A, the actuator unit 17 is a stacked body composed of three piezoelectric layers 17*a*, 17*b* and 17*c*. The piezoelectric layers 17*a*, 17*b* and 17*c* are all sheets formed of a ferroelectric ceramics of lead zirconium titanate (PZT), and have the same thickness. The piezoelectric layers 17*a*, 17*b* and 17*c* have the same size and shape in planar view (the trapezoidal shape defining one actuator unit 17). One actuator unit 17 is arranged to face and stride, over a number of pressure chambers 16 included in one pressure chamber group, and the piezoelectric layer 17*c* seals up one pressure chamber group entirely. The piezoelectric layer 17*a* is polarized in the stacking direction of these piezoelectric layers 17*a* to 17*c*.

On a surface 17*a*1 of the piezoelectric layer 17*a*, a number of individual electrodes 18*a* are formed at positions facing the pressure chambers 16, respectively. A common electrode 19 is formed between the piezoelectric layer 17*a* and the lower piezoelectric layer 17*b*, while a metallic layer 20 is formed between the piezoelectric layer 17*b* and the lowest piezoelectric layer 17*c*. No electrode is formed on the lower surface of the piezoelectric layer 17*c*. The common electrode 19 and the metallic layer 20 are formed on the entire upper surfaces of the piezoelectric layers 17*b* and 17*c*, respectively. All of the individual electrodes 18*a*, the common electrode 19 and the metallic layer 20 are formed of gold (Au) and have a thickness of approximately 1 μm.

The common electrode 19 and the metallic layer 20 are formed on the entire surfaces of the piezoelectric layers 17*b* and 17*c*, respectively, and function as electrodes common to all the pressure chambers 16 corresponding to one actuator unit 17.

In the same manner as the pressure chambers 16, the individual electrodes 18*a* are arranged in a matrix form to constitute a plurality of rows and a plurality of columns. Each individual electrode 18*a* is, as shown in FIG. 6B, formed of a main portion 18*a*1 and an extension portion 18*a*2. The main portion 18*a*1 is one size smaller than the pressure chamber 16. The approximately rhombic main portion 18*a*1 is similar to the pressure chamber 16 in shape, and is positioned interiorly within the contour of the pressure chamber 16 in planar view. The extension portion 18*a*2 extends from one acute-angled portion of the main portion 18*a*1 up to the outside of the pressure chamber 16 along the surface 17*a*1. On the end of the extension portion 18*a*2, a cylindrical land 18*b* formed of Ag—Pd (silver-palladium) and the like is formed.

In addition to the lands 18*b*, lands 18*c* for the common electrode 19 and metallic layer 20 (see FIG. 3) are also formed on the surface 17*a*1. The lands 18*c* are arranged on the surface 17*a*1 in the vicinity of the upper base and the lower base of the trapezoid, and connected to the common electrode 19 via through holes formed in the piezoelectric layer 17*a*. The metallic layer 20 is connected with the common electrode 19 via a through hole formed in the piezoelectric layer 17*b* at the corner of the trapezoidal actuator unit 17 in planar view. Each of the lands 18*b* and 18*c* is adhered to a contact point 52*d* of the COF 50*x* with a bump 18*d* made of an electrically conductive adhesive (such as thermosetting resin, solder, and the like).

To each of the individual electrodes 18*a*, a pulsing drive potential is applied based on the image data, whereas the common electrode 19 and metallic layer 20 are constantly maintained at the ground potential. The piezoelectric layer 17*a* has active portions in the portions sandwiched between the individual electrodes 18*a* and the common electrode 19. The active portions are displaced in at least one vibrational mode selected from $d_{31}$, $d_{33}$, and $d_{15}$ (in $d_{31}$ for the embodiment). The portions of the piezoelectric layers 17*b* and 17*c* facing the active portions are inactive portions. That is, the actuator unit 17 includes a unimorph-type piezoelectric actuator formed of a stacked body composed of one layer active portion and two layers inactive portions for each of the pressure chambers 16. Each piezoelectric actuator is deformable independently.

The COF 50*x* has a flexible plate-like base material 51 made of an insulating material such as polyimide and the like, wires 52, the contact points 52*d*, and a covering layer 53 formed to cover the wires 52. On a surface 51*a* of the base material 51, there are formed the contact points 52*d* corresponding respectively to the lands 18*b* and 18*c*, and the wires 52 connected respectively to the contact points 52*d*. The contact points 52*d* are to be connected to the individual electrodes 18 (or the common electrode 19) via the lands 18*b* (or the lands 18*c*) and the bumps 18*d*. The contact points 52*d* are provided at the ends of the wires 52. The covering layer 53 is made of an insulating material such as resins of the polyimide series and urethane series, etc., and formed on almost the entire surface 51*a* of the base material 51 (except the portions for the contact points 52*d*). The covering layer 53 covers the wires 52 on the surface 51*a* of the base material 51 while exposing each contact point 52*d*.

Two driver ICs 57 (see FIG. 9A) are mounted on the COF 50*x*. The contact points 52*d* formed on the surface 51*a* of the base material 51 are classified into two groups. The contact points 52*d* belonging to one group are connected to the output terminals of one driver IC 57, while the contact points 52*d* belonging to the other group are connected to the output terminals of the other driver IC 57, respectively; through the wires 52. For example, the contact points 52*d* formed on the surface 51*a* of the base material 51 are classified into two groups for the left half and the right half of the COF 50*x* with the longitudinal center as the borderline in FIG. 9A. Then, the wires 52 of the contact points 52*d* belonging to the left-half group are drawn out to the left side to be connected to the output terminals of the driver IC 57 on the left side, while the wires 52 of the contact points 52*d* belonging to the right-half group are drawn out to the right side to be connected to the output terminals of the driver IC 57 on the right side.

Under the control of the controller 1*p* (see FIG. 1), the drivers IC 57 receive the data adjusted by the substrate 64 via the FPC 50*y* and, based on this data, generate drive signals which are then supplied respectively to the electrodes of the actuator unit 17 via the wires 52, the contact points 52*d*, and the bumps 18*d*. The actuator unit 17 causes the pressure chambers 16 to change in volume by applying the drive potential to the individual electrodes 18*a* to displace or deform the piezoelectric actuators. By virtue of this, the jetting energy is applied to the ink inside the pressure chambers 16, and thereby ink is jetted from the jetting ports 14*a*.

A concrete configuration of the entire wiring module 50 will be described in the following explanation for a manufacturing method.

Figure 7:
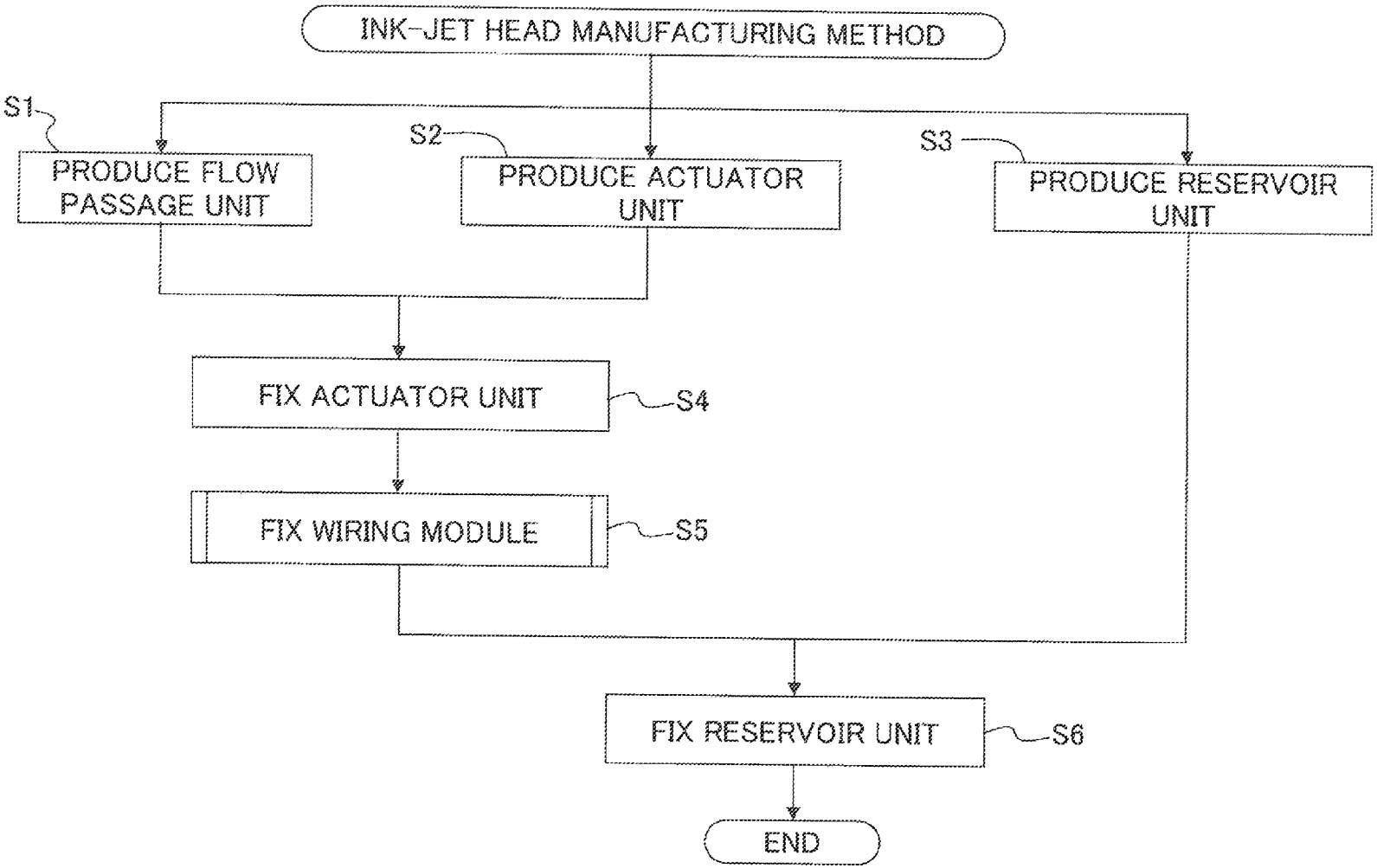
FIG. 7 is a flow diagram showing a method for manufacturing the ink-jet head.

Next, referring to FIG. 7, a method for manufacturing the ink jet head 10 will be explained.

First, the flow passage unit 12, the actuator units 17, and the reservoir unit 11 are produced separately (S1, S2, and S3). These processes S1, S2 and S3 are carried out independently. Any of the processes may be carried out ahead of or in parallel with the others.

In S1, through holes are formed respectively in nine metallic plates to prepare the plates 12*a* to 12*i*. The flow passage unit 12 is produced by stacking these plates 12*a* to 12*i* to adhere the same together while positioning for one another. Adhesion of the plates 12*a* to 12*i* may be carried out by a method employing epoxy adhesive or the like, as well as by a method without utilizing adhesive such as metal joining.

In S2, the eight actuator units 17 are produced. First, three green sheets of piezoelectric ceramics are prepared for forming the piezoelectric layers 17*a*, 17*b* and 17*c*. Au paste is applied on two of the three green sheets (for forming the piezoelectric layers 17*b* and 17*c*) by means of screen printing as the patterns of the common electrode 19 and the metallic layer 20, respectively. Then, from under the unprinted green sheet for the piezoelectric layer 17*a*, the green sheet for the piezoelectric layer 17*b* is superimposed to sandwich the Au common electrode pattern. Further, from under the green sheet for the piezoelectric layer 17*b*, the green sheet for the piezoelectric layer 17*c* is superimposed to sandwich the Au metallic layer pattern. The stacked body thus obtained is then degreased and fired in the same manner as publicly-known ceramics. At the time, the three green sheets become the piezoelectric layers 17*a*, 17*b* and 17*c*, while the Au paste portions become the common electrode 19 and the metallic layer 20. After that, Au paste is applied on the surface 17*a*1 by means of screen printing as the pattern of the individual electrodes 18*a*. Then, this Au paste is fired to form the individual electrodes 18*a* on the surface 17*a*1. Thereafter, Ag—Pd paste is printed on the end of each extension portion 18*a*2 to form the land 18*b*. At the same time, the lands 18*c* for the common electrode 19 and the metallic layer 20 are also formed on the surface 17*a*1 in predetermined positions. Each of the lands 18*b* and 18*c* is fired at a predetermined temperature. In this manner, each actuator unit 17 is produced.

In S3, through holes and recesses are formed respectively in four metallic plates to prepare the plates 11*a* to 11*d*. Then, the reservoir unit 11 is produced by stacking these four plates

11*a* to 11*d* to join the same together while positioning for one another. The method for adhering the plates 11*a* to 11*d* is the same as that utilized for the flow passage unit 12.

Next, the whole structure of the eight actuator units produced in S2 is fixed to the flow passage unit 12 produced in S1 while making the main portions 18*a*1 face the pressure chambers 16 in planar view (S4). The fixation is carried out through epoxy adhesive. At the time, the actuator units 17 are arranged to be adjacent to each other in two rows of a zigzag pattern on the upper surface 12*x* of the flow passage unit 12.

After S4, the wiring module 50 is fixed to each actuator unit 17 (S5). After S5, the reservoir unit 11 produced in S3 is fixed to the flow passage unit 12 (S6). Then, the manufacturing of the ink-jet head 10 is completed through a process to electrically connect the FPC 50*y* and the substrate 64 via the connector 64*a*, a process to set the side cover 65*b* and the top cover 65*a* to enclose the reservoir unit 11 and the actuator units 17 with the flow passage unit 12, and other processes.

Next, referring to FIG. 8 and FIGS. 9A to 9K, a wiring module fixation process (S5) will be explained. Further, FIGS. 9C, 9F, 9I and 9K are cross-sectional views taken along the lines IXC-IXC, IXF-IXF, DCI-IXI and IXK-IXK shown in FIGS. 9B, 9E, 9H and 9J, respectively.

Figure 8:
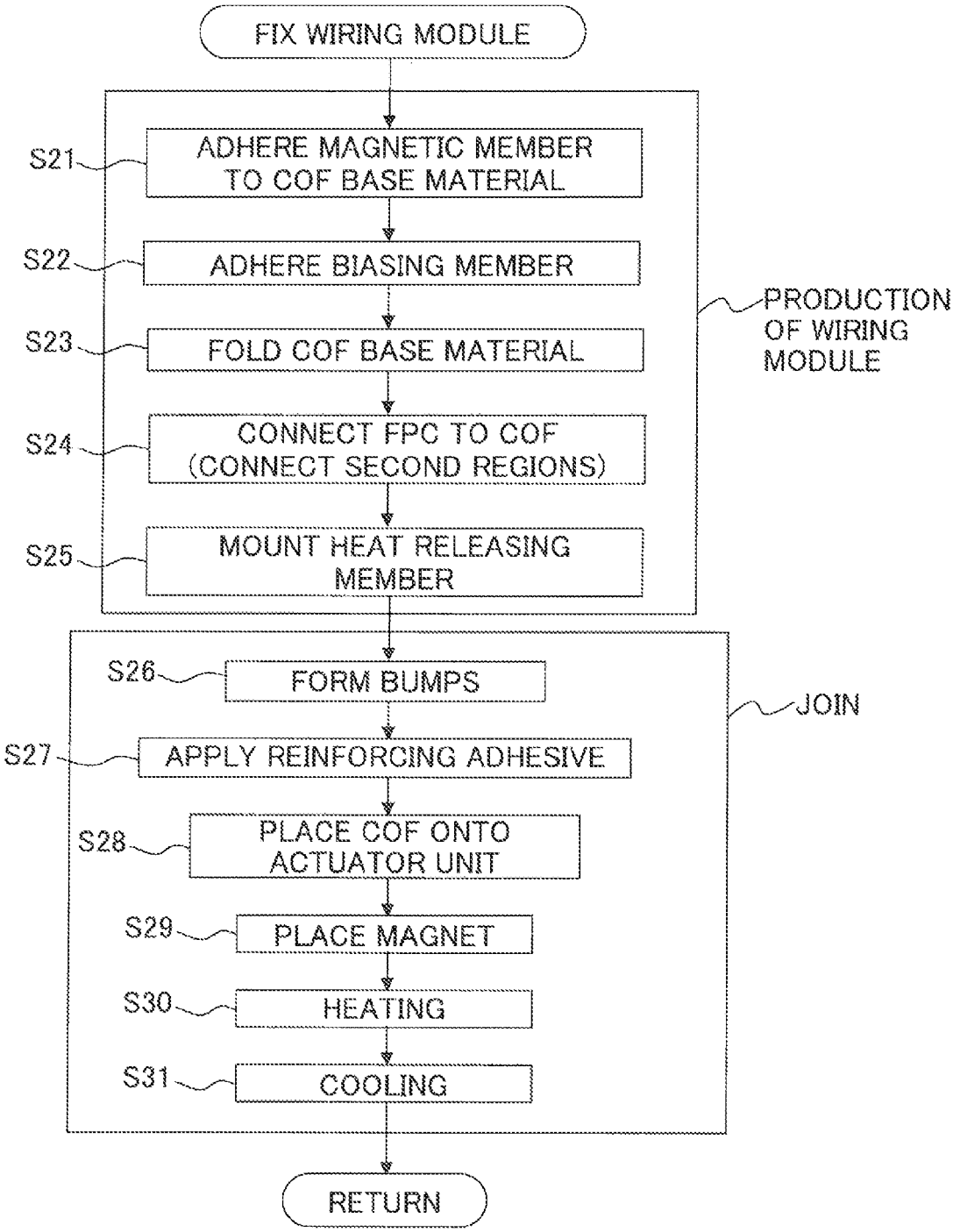
FIG. 8 is a flow diagram showing each step of a wiring module fixing process.

As shown in FIG. 8, the wiring module fixation process (S5) is divided into a "wiring module Production process" for producing the wiring module 50 and a "joining process" for joining the contact points 52*d* of the COF 50*x* and the lands 18*b* of the actuator unit 17 for each wiring module 50. The joining process is carried out after the wiring module production process.

In the wiring module production process, the eight wiring modules 50 are produced. Hereinbelow, the procedure of producing one wiring module 50 will be explained.

Figures 9A, 9B, 9C, 9D, 9E, 9F, 9G, 9H, 9I, 9J, 9K:
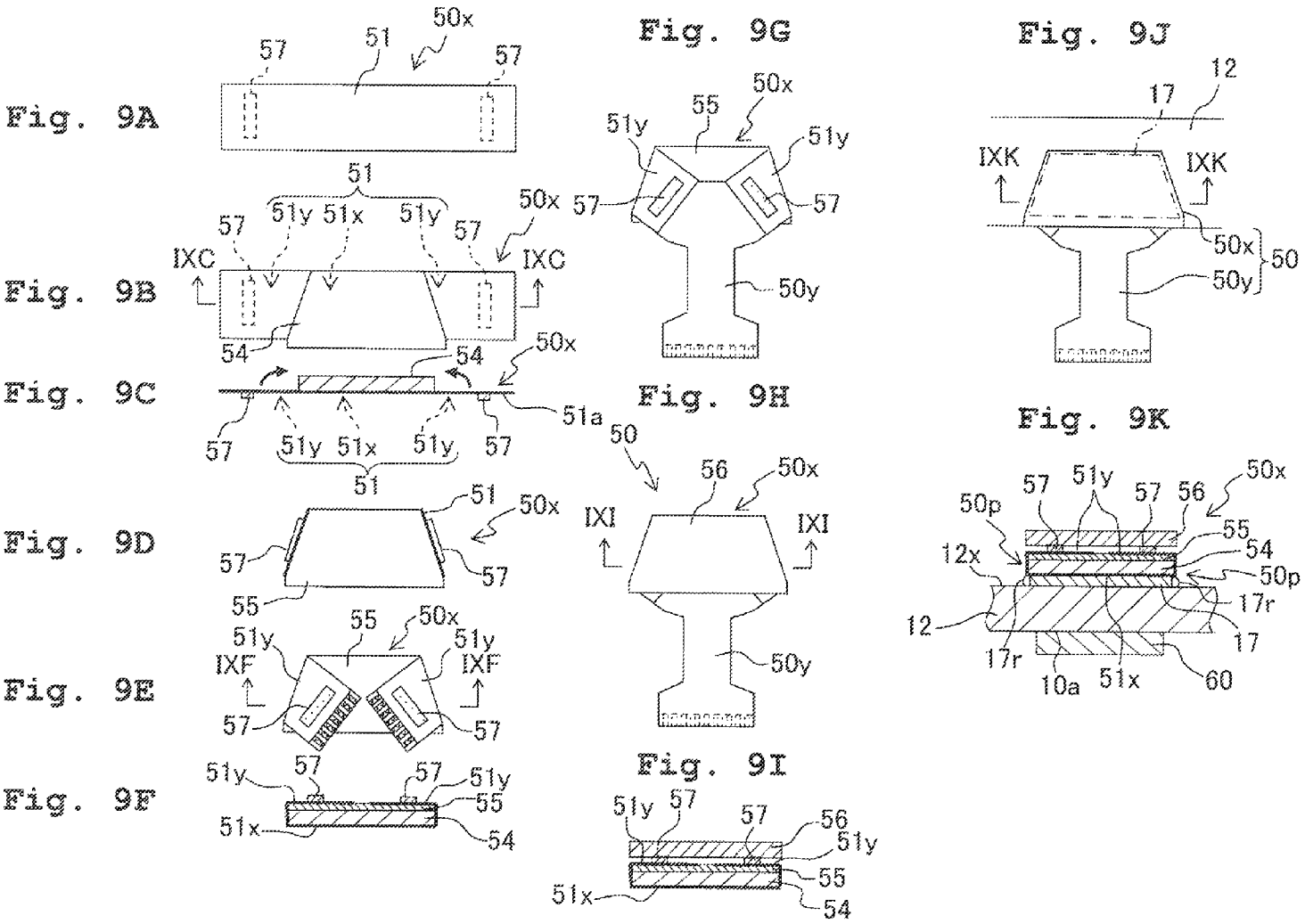
FIGS. 9A to 9K are plan views and cross-sectional views of carrying out steps of the wiring module fixing process.

First, as shown in FIG. 9A, the COF 50*x* is prepared, having the rectangular base material 51 elongated in one direction. FIG. 9A shows the back surface of the COF 50*x* (the surface on the side opposite to the surface 51*a* on which the contact points 52*d*, the wires 52 and the drivers IC 57 are arranged). Then, as shown in FIGS. 9B and 9C, a magnetic member 54 is adhered to the back surface of the base material 51 at the approximately central position (S21).

The magnetic member 54 is a plate-like member having almost the same shape and size as the actuator unit 17 in planar view (specifically, it is one size larger than the actuator unit 17). The magnetic member 54 is made of the same metallic material (SUS 430 or the like) as the plates 12*a* to 12*i* constituting the flow passage unit 12, and has the same coefficient of thermal expansion as the flow passage unit 12.

The surface 51*a* of the base material 51 has a first region 51*x* in which the plurality of contact points 52*d* are formed and which overlaps the actuator unit 17 (to be arranged to face the actuator unit 17 in S28 described later), and second regions 51*y* different from the first region 51*x* and on which the contact points 52*d* are not formed. In S21, the magnetic member 54 is arranged to face the first region 51*x* entirely. The second regions 51*y* are provided to extend on both sides of the base material 51 with respect to the first region 51*x* in the longitudinal direction, respectively. With the wiring module 50 being fixed on the actuator unit 17 as shown in FIG. 2, when unfolded (expanded) on the plane as shown in FIGS. 9B and 9C, at least a part of each of the second regions 51*y* overlaps, in planar view, with another actuator unit 17 different from the actuator unit 17 overlapping the first region 51*x* (an actuator unit 17 adjacent to the corresponding actuator unit 17 in the main scanning direction). The driver ICs 57 are fixed on the second regions 5*l* y, respectively.

After S21, a biasing member 55 is adhered onto the magnetic member 54 (S22). The biasing member 55 is a sponge having the same shape and size as the magnetic member 54. The biasing member 55 is elastic and adiabatic, and has a function to bias the driver ICs 57 toward an aftermentioned heat releasing member 56 (see FIG. 9I), a function to restrain the transmission of the heat generated by the driver ICs 57, etc.

After S22, the second regions 51*y* of the base material 51 are erected upward along the lateral sides of the magnetic member 54 as shown by the thick arrows of FIG. 9C (see FIG. 9D) and, furthermore, the base material 51 is folded back along the lateral sides of the stacked body composed of the magnetic member 54 and the biasing member 55 as shown in FIGS. 9E and 9F (S23). Here, the erective state of the second regions 51*y* can be maintained by, for example, applying adhesive or affixing a two-sided adhesive tape to the lateral sides of the magnetic member 54 in advance, and erecting the second regions 51*y* upward to cause the vicinities of the folding portions of the base material 51 in the second regions 51*y* to adhere to the lateral sides of the magnetic member 54. Maintaining the erective state facilitates maintaining the folded state. In addition, the erective state of the second regions 51*y* can as well be maintained by various other methods such as to make pins provided on the lateral sides of the magnetic member 54 engage with holes provided in the folded portions of the base material 51, etc.

When folding the base material 51 in S23, the second regions Sly are folded inward to face the biasing member 55. By virtue of this, each of the second regions 51*y* does not overlap with the another actuator unit 17 different from the actuator unit 17 overlapping the first region 51*x* in planar view (an actuator unit 17 adjacent to the corresponding actuator unit 17 in the main scanning direction) with the wiring module 50 being fixed on the actuator unit 17 as shown in FIG. 2 (that is, when the first region 51*x* is caused to face the actuator unit 17). Further, at that time the driver ICs 57 are arranged in predetermined positions so that entire surface of each of the driver ICs 57 overlaps (faces) the magnetic member 54 and the biasing member 55 in planar view.

After S23, as shown in FIG. 9G, one end of the FPC 50*y* is connected to the COF 50*x*. The FPC 50*y* has a flexible plate-like base material made of an insulating material such as polyimide and the like, and a plurality of wires formed on the surface of the base material to correspond respectively to the wires 52. In S24, the wires of the FPC 50*y* are connected respectively to the wires 52 of the two second regions 51*y*. By virtue of this, the input terminals for the two second regions 51*y* are converted to the input terminals for the one FPC 50*y*. In this manner, by connecting the two second regions 51*y* with the FPC 50*y*, it is possible to maintain the base material 51 in the folded state. Further, the connection between the wires of the FPC 50*y* and the wires 52 of the second regions 51*y* is carried out by utilizing a conductive adhesive (thermosetting resin, solder, ACF-Anisotropic Conductive Film, and the like). Because the magnetic member 54 is placed on the base material 51, it is possible to sufficiently apply pressure on the FPC 50*y* and the second regions 51*y* of the base material 51 at the time of connecting the FPC 50*y* to the second regions 51*y*.

After S24, the heat releasing member 56 is fixed onto the driver ICs 57 as shown in FIGS. 9H and 9I (S25). The heat releasing member 56 has the same shape and size as the magnetic member 54, and is adhered to the upper surfaces of the two driver ICs 57 (the surfaces on the side opposite to the surfaces facing the actuator unit 17 in S28 described later). The heat releasing member 56 faces the stacked body composed of the magnetic member 54 and the biasing member 55 and the entire COF 50*x* adhered to cover the stacked body. The heat releasing member 56 is made of metal or the like, and releases the heat generated by the driver ICs 57.

The production of the wiring module 50 is thus completed through the processes of S21 to S25 (see FIG. 9H).

After the eight wiring modules 50 are produced in the above manner, the joining process is carried out. Hereinbelow, the procedure of the joining process will be explained.

First, each bump 18*d* (see FIG. 6A) is formed (S26). If the bump 18*d* is to be made of thermosetting resin, then it is formed by applying the thermosetting resin on each of the lands 18*b* and 18*c* of the actuator unit 17 by screen printing and the like. At the time, the screen printing may be carried out for the eight actuator units 17 collectively at one time.

After S26, a reinforcing adhesive 17*r* (thermosetting adhesive and the like, see FIG. 9K) is applied to the upper surface 12*x* of the flow passage unit 12 along the outer edge of each actuator unit 17 (S27). Further, if the bump 18*d* is made of thermosetting resin, then S27 and S26 may as well be carried out concurrently.

After S27, as shown in FIGS. 9J and 9K, each COF 50*x* is placed on the corresponding actuator unit 17, while adjusting the position between each contact point 52*d* of the COF 50*x* and the land 18*b* or 18*c* (S28). Here, the stacked body composed of the magnetic member 54 and the biasing member 55 and the COF 50*x* adhered to cover the stacked body has protrusions 50*p* protruding from the outer edge of the actuator unit 17 in a direction parallel to the upper surface 12*x* of the flow passage unit 12. The reinforcing adhesive 17*r* applied in S27 stands between the portions of the base material 51 corresponding to the protrusions 50*p* and the upper surface 12*x* of the flow passage unit 12.

After S28, a magnet 60 is placed on the lower surface of the flow passage unit 12 (the jetting surface 10*a*) in the portion facing each actuator unit 17 (S29). By virtue of this, an attractive force toward the magnet 60 acts on the magnetic member 54 to solidly fix the wiring module 50 on the actuator unit 17.

After S29, the flow passage unit 12 on which the eight actuator units 17 and the corresponding wiring modules 50 are arranged is heated in a heating furnace (S30), and then cooled (S31).

Through the processes of S26 to S31, the contact points 52*d* of the COF 50*x* of each wiring module 50 are connected to the lands 18*b* of the actuator unit 17. That is, it is realized that the COF 50*x* of each wiring module 50 is mechanically connected to the actuator unit 17 as well as each contact point 52*d* is electrically connected to the corresponding individual electrode 18*a*. Further, it is also realized that each COF 50*x* is adhered to the flow passage unit 12 by hardening the reinforcing adhesive 17*r* in S30.

When the bump 18*d* is made of solder (low-temperature solder and the like), it may be formed by applying the solder to each contact point 52*d* of the COF 50*x* by screen printing and the like in S26. Further, when the bump 18*d* is made of solder (low-temperature solder and the like), the series of processes S26 to S31 may be carried out with respect to each actuator unit 17 (e.g., in sequence from the topmost actuator unit 17 in FIG. 2). First, for example, the bump 18*d* is formed on each contact point 52*d* of the COF 50*x* of one wiring module 50 corresponding to the topmost actuator unit 17 in FIG. 2 (S26), and then the reinforcing adhesive 17*r* is applied along the outer edge of the actuator unit 17 (S27). Next, the COF 50*x* on which the bumps 18*d* are formed in S26 is arranged on the actuator unit 17 (S28). Thereafter, one magnet 60 is placed on the lower surface of the flow passage unit 12 (the jetting surface 10*a*) at position facing the actuator unit 17 (S29) and, through the processes of heating (S30) and cooling (S31) the actuator unit 17, the joining process for the actuator unit 17 is finished. Subsequently, the above series of processes are carried out for the second top actuator unit 17 in FIG. 2. In this manner, the above series of processes may be carried out in sequence for the eight actuator units 17. Further, in the above case, a trapezoidal heater of the same shape as the actuator unit 17 in planar view may be arranged on the heat releasing member 56 in S30, so as to carry out the heating process while applying pressure to the joining portions between the contact points 52*d* and the bumps 18*d*.

As described hereinabove, according to the ink-jet head 10 of the embodiment, the second regions 51*y* of the base material 51 of each COF 50*x* are folded in such a manner as not to overlap another actuator units 17 in planar view (see FIG. 9J). According to the method for manufacturing the ink jet head 10 in the embodiment, after the folding process (S23), the joining process is carried out in a state that the base material 51 is maintained in the folded state and the first region 51*x* faces the actuator unit 17 (see FIGS. 9J and 9K). By virtue of this, even if the base material 51 of the COF 50*x* in an unfolded state may overlap another actuator units 17, it is still possible to carry out the joining process easily.

The ink-jet head 10 has the magnetic member 54 placed on the base material 51 at a position overlapping the actuator unit 17 in planar view (see FIGS. 9J and 9K). The ink-jet head manufacturing method has a process (S29) for placing the magnet 60 in such a position as to sandwich at least the first region 51*x* of the base material 51 and the actuator unit 17 with the magnetic member 54 in the joining process. By virtue of this, it is possible to carry out the joining process easily by utilizing the magnetic force exerted by the magnet 60. Further, by the application of pressure utilizing the magnetic force, it is possible to improve the joint strength between the contact points 52*d* and the individual electrodes 18*a*.

The magnetic member 54 has the same coefficient of thermal expansion as the upper surface 12*x* of the flow passage unit 12. By virtue of this, it is possible to reduce the thermal stress occurring in the COF 50*x* due to the heat during the heating process in the joining process or the heat generated during the use of the ink-jet head. Further, it is possible to restrain the contact points 52*d* from coming off the individual electrodes 18*a*.

The magnetic member 54 faces the entire first region 51*x* (see FIGS. 9J and 9K). According to the method for manufacturing the ink-jet head 10, the magnetic member 54 is placed to face the entire first region 51*x* in S21. By virtue of this, with respect to all the contact points 52*d* formed in the first region 51*x*, it is possible to carry out an application of pressure utilizing magnetic force in the joining process. Thereby, it is possible to improve the joint strength between the contact points 52*d* and the individual electrodes 18*a*.

According to the method for manufacturing the ink-jet head 10, in the process (S21) of placing the magnetic member 54 carried out before the folding process (S23), the plate-like magnetic member 54 which has the same shape and size as the actuator unit 17 is utilized (see FIGS. 9J and 9K). By virtue of this, in the folding process (S23), it is possible to erect the second regions 51*y* of the base material 51 upward along the lateral sides of the magnetic member 54 and maintain the second regions 51*y* in the erect state. Therefore, it is possible to carry out the folding process (S23) easily. Further, the plate-like magnetic member 54 does not get in the way of the operation for the folding process (S23).

The COF 50*x* and the flow passage unit 12 are bonded with the reinforcing adhesive 17*r* applied between the portions of the base material 51 corresponding to the protrusions 50*p* and the upper surface 12*x* of the flow passage unit 12 (see FIG. 9K). The method for manufacturing the ink-jet head 10 has a process for applying the reinforcing adhesive 17*r* (S27) followed by a reinforcement adhesion process (the heating process of S30) for adhering the COF 50*x* and the flow passage unit 12 with this reinforcing adhesive 17*r*. By virtue of this, it is possible to effectively restrain the wiring module 50 from coming off the actuator unit 17 and, as a consequence, improve the reliability of the electrical connection between the contact points 52*d* and the individual electrodes 18*a*.

The driver ICs 57 are fixed in the second regions 51*y* of the base material 51 and arranged at predetermined positions so that entire surface of each of the driver ICs 57 overlaps with the actuator unit 17 in planar view (see FIGS. 9J and 9K). According to the method for manufacturing the ink jet head 10, the joining process is carried out with the COF 50*x* being placed such that the entire surface of each of the driver ICs 57 overlaps with the actuator unit 17 in planar view. By virtue of this, since the entire surface of each of the driver ICs 57 is supported by the actuator unit 17, it is possible to restrain localized stress from acting on the driver ICs 57.

The ink-jet head 10 has the heat releasing member 56 which is placed on the surfaces of the driver ICs 57 at the side opposite to the surfaces facing the actuator unit 17 to release the heat generated by the driver ICs 57. The method for manufacturing the ink-jet head 10 includes a process for placing the heat releasing member 56 (S25). By virtue of this, it is possible to effectively release the heat generated by the driver ICs 57 in the space facing the actuator unit 17 with the heat releasing member 56.

The ink-jet head 10 has the biasing member 55 which is arranged so that the driver ICs 57 and COF 50*x* are sandwiched between the biasing member 55 and the heat releasing member 56 and which biases the driver ICs 57 toward the heat releasing member 56. The method for manufacturing the ink-jet head 10 includes a process (S22) for placing the biasing member 55. This ensures a tight contact of the driver ICs 57 with the heat releasing member 56, thereby improving the effect of heat release by the heat releasing member 56.

The base material 51 has the two second regions 51*y*, which extend in directions different from each other with respect to the first region 51*x* in a state that the base material 51 is unfolded (expanded) to be parallel to the upper surface 12*x* of the flow passage unit 12. In addition, the driver ICs 57 are respectively fixed on the two second regions 51*y*, and the two second regions 51*y* are connected to the FPC 50*y* (see FIG. 9G). The method for manufacturing the ink jet head 10 includes a connecting process (S24) for maintaining the base material 51 in the folded state by connecting the two second regions 51*y* to the FPC 50*y*. In this manner, by constructing the wiring module 50 with the COF 50*x* and the FPC 50*y*, it is possible to reduce the cost compared with the case of constructing the entire wiring module 50 with the COF 50*x* alone (because the COF 50*x* is comparatively expensive). Further, the FPC 50*y* also contributes to maintaining the base material 51 in the folded state as described hereinabove. That is, the FPC 50*y*, which is originally included in the ink-jet head 10 as a component, plays a useful role in maintaining the base material 51 in the folded state, and thus neither special members nor processes are needed for maintaining the folded state. Therefore, it is possible to effectively prevent the construction and manufacturing process of the ink-jet head 10 from becoming complicated.

Hereinabove, the explanation was made with respect to the preferred embodiment of the present teaching. However, the present teaching is not limited to the above embodiment, but allows various changes in design in so far as in accordance with the accompanying claims.

Figure 10A:
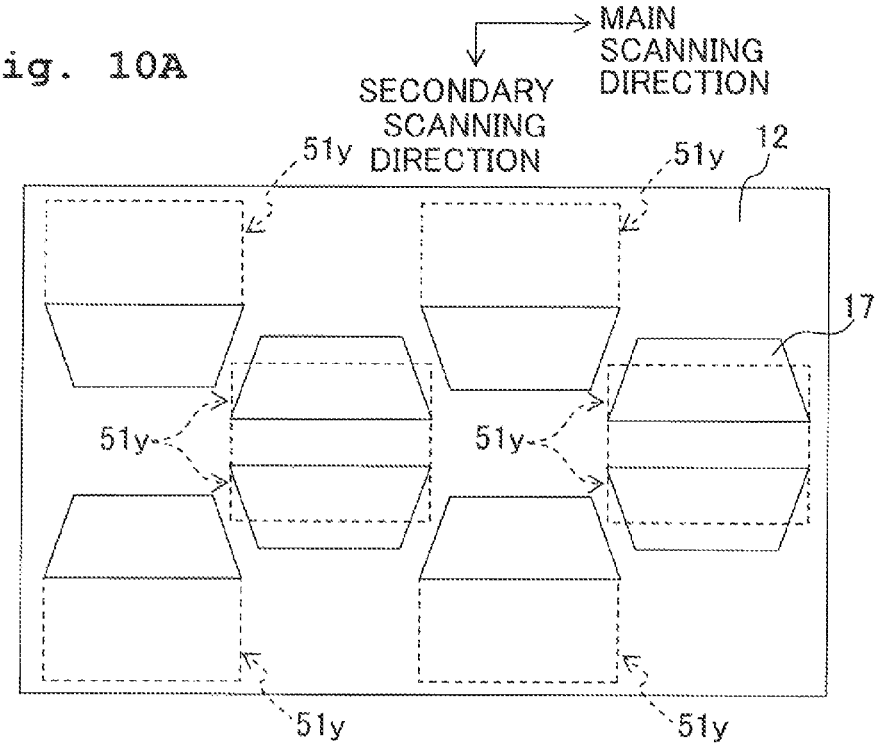
FIGS. 10A to 10C are plan views showing modifications of a base material.
Figure 10B:
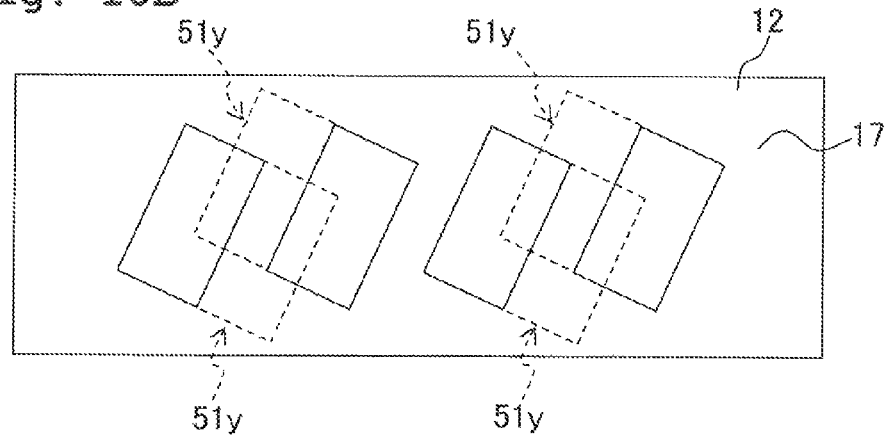

It is possible to change the configuration of the actuator units such as follows. The number of the actuator units included in one liquid-jetting head may be two or more. One actuator unit may include an arbitrary number of the piezoelectric layers, and an arbitrary number, shape, size, material and the like of the electrode layers (the common electrode and metallic layer). The contact points of the wiring member may be directly connected to the individual electrodes without utilizing the lands. The actuators are not limited to the piezoelectric type utilizing piezoelectric elements, but may as well be of other types (such as the thermal type utilizing heating elements, the electrostatic type utilizing electrostatic force, and the like). It is possible to change the arrangement of the actuator units on the surface of the flow passage unit in various ways. As shown in FIG. 10A for example, the trapezoidal actuator units 17 in planar view may be arranged such that the upper bases are facing each other and the lower bases are facing each other. Further, as shown in FIG. 10B, the parallelogram actuator units 17 in planar view may be aligned in one direction.

Figure 10C:
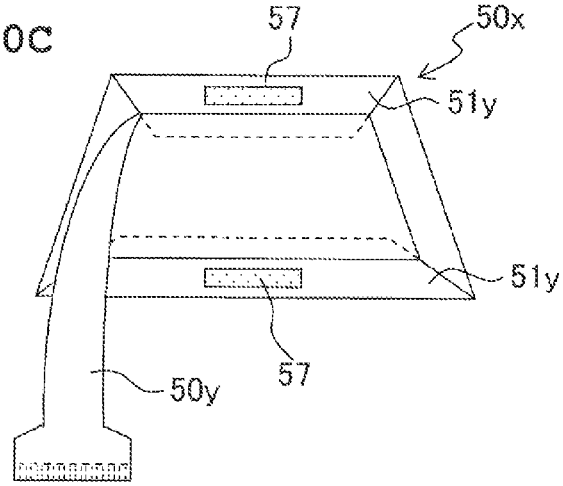

It is possible to change the configuration of the wiring members such as follows. The entire wiring member may be constituted of a COF or a FPC. The covering layer 53 of the COF may be omitted. One base material may have an arbitrary number of the second regions, which then may extend in an arbitrary direction and the like with respect to the first region. For example, the base material may have, as shown in FIG. 10A, a second region 51*y* extending only from the lower-base side when unfolded to be parallel to the surface of the flow passage unit 12. The base material may have, as shown in FIG. 10B, a second region 51*y* extending from one of the two sides, of the parallelogram actuator units 17, facing each other in planar view when unfolded to be parallel to the surface of the flow passage unit 12. The base material may have, as shown in FIG. 10C, two second regions 51*y* extending respectively from the upper base and the lower base of a trapezoidal actuator unit 17 when unfolded to be parallel to the surface of the flow passage unit 12, and these two second regions 51*y* may be folded inward respectively and connected to the FPC 50*y*. Further, the base material may have a second region extending in the main scanning direction with respect to the first region, and another second region extending in the secondary scanning direction with respect to the first region.

It is possible to change the configuration of the drive circuits such as follows. The wiring member may be provided with an arbitrary number of the drive circuits at arbitrary positions and the like. For example, the drive circuits may as well be fixed in the first region of the base material or only in one of the multiple second regions included in the base material. Further, the drive circuits may as well be fixed not on the surface of the COF but on the surface of the FPC (for example, the portion of the FPC 50*y* arranged on the lateral side of the reservoir unit 11). The drive circuits may as well not be located in a position of fully overlapping the actuator unit.

The heat releasing member and the biasing member may have an arbitrary shape, size, material, and the like, respectively. Further, in the embodiment, although a sponge is utilized as the biasing member, a plate spring and the like may as well be utilized as long as it is possible to bias the driver ICs 57 toward the heat releasing member 56. Further, in the embodiment, although the biasing member 55 has almost the same shape and size as the magnetic member 54 and is provided on the entire surface of the magnetic member 54, it may as well be provided only on a part of the surface overlapping the driver ICs 57. Further, these members may as well be omitted.

It is possible to change the configuration of the magnetic member such as follows. The magnetic member may be arranged in the second region instead of the first region. The magnetic member may have an arbitrary shape, size, and the like. For example, it may be one size smaller than the actuator unit. The magnetic member may be made of an arbitrary material, which can be different from that of the plates 12*a* to 12*i* constituting the flow passage unit 12. It is preferable that the magnetic member at least have the same coefficient of thermal expansion as the surface of the flow passage unit (the surface on which the actuator units are placed). For example, when the flow passage unit is composed of a plurality of plates as in the aforementioned embodiment, the coefficient of thermal expansion of the magnetic member may be the same as that of the topmost plate 12*a* but different from the coefficients of thermal expansion of the other plates 12*b* to 12*i*. Further, although the coefficient of thermal expansion of the magnetic member is preferably the same as that of the surface of the flow passage unit, it is not limited to that. For example, the coefficient of thermal expansion of the magnetic member may as well be not the same as but closer to that of the surface of the flow passage unit than that of the base material. By virtue of this, it is possible to take in the heat expansion of the base material 51 during the heating in S30. The magnetic member may as well be omitted. (In such a case, the magnet placement process may be omitted from the ink-jet head manufacturing method.)

The reinforcing adhesive 17*r* may as well be applied to only a part of but not the entire circumference of the outer edge of the actuator unit. Further, the reinforcing adhesive 17*r* may as well be omitted.

Especially, it is possible to change the manufacturing method such as follows. The wiring module production process may be carried out before the wiring module fixation process (S5). That is, a plurality of wiring modules may be produced prior to S5, and only the joining process be carried out in S5. The process for placing the magnetic member (S21) may as well be carried out after the folding process (S23). The process for bonding the biasing member (S22) may as well be carried out after erecting up the second regions 51*y* of the base material 51 and before folding back the base material 51 along the lateral sides of the stacked body composed of the magnetic member 54 and the biasing member 55. The reinforcing adhesive 17*r* may be applied in the same process for forming the bumps 18*d*. In such a case, it is preferable that the reinforcing adhesive 17*r* and the bumps 18*d* be made of the same material. The connecting process (S24) for connecting the plurality of second regions to the FPC may be carried out not after but before the folding process (S23). Further, it may as well be carried out after the joining process. The process (S5) for fixing the wiring member to the actuator unit may as well be carried out before the process (S4) for fixing the actuator units to the flow passage unit. In such a case, the magnet may be arranged below the actuator unit in the magnet arrangement process (S29).

The liquid-jetting head in accordance with the present teaching is not limited to the application to printers but is applicable to any liquid-jet apparatuses such as facsimile machines, copy machines, and the like. Further, the number of the liquid-jetting heads applied to liquid-jet apparatuses is not limited to four but may be one or more. The liquid-jetting head is not limited to the line type but may as well be the serial type. Further, the liquid jetting head in accordance with the present teaching may jet any liquids other than ink.

What is claimed is:

1. A method for manufacturing a liquid-jetting head which jets a liquid, comprising:

providing a flow passage unit in which a plurality of jetting ports from which the liquid is jetted and a plurality of individual liquid flow passages which are connected to the jetting ports respectively are formed;

providing a plurality of actuator units, which are arranged to be adjacent to each other on a surface of the flow passage unit, each of which includes a plurality of actuators having individual electrodes each corresponding to one of the individual liquid flow passages, and each of which imparts a jetting energy to the liquid in the individual liquid flow passages by driving the actuators;

providing a drive circuit, for each of the actuator units, which supplies drive signals to the actuators;

providing a plurality of wiring members each of which is fixed on one of the actuator units to electrically connect the one of the actuator units and the drive circuit, and each of which includes:

a plurality of contact points to be connected to the individual electrodes of the actuators;

a plurality of wires connected to the contact points respectively; and a base material on which the contact points and the wires are formed, wherein the base material has:

a first region in which the plurality of contact points are formed and which faces one actuator unit among the actuator units; and a second region which is different from the first region and in which the contact points are not formed; and wherein the base material is configured such that at least a part of the second region overlaps with another actuator unit adjacent to the one actuator unit in a first direction perpendicular to the surface of the flow passage unit in a state that the base material is unfolded to be parallel to the surface of the flow passage unit;

folding the base material such that the second region does not overlap with the another actuator unit in the first direction in a state that the first region faces the one actuator unit;

joining the contact points of the base material respectively to the individual electrodes of the one actuator unit in a state that the first region faces the one actuator unit after folding the base material; and placing a magnetic member on the base material before joining the contact points to the individual electrodes, wherein when joining the contact points to the individual electrodes, a magnet is placed in such a position that at least the first region of the base material and the actuator unit are sandwiched between the magnet and the magnetic member.

2. The method for manufacturing the liquid-jetting head according to claim 1;

wherein coefficient of thermal expansion of the magnetic member is closer to that of the surface of the flow passage unit than that of the base material.

3. The method for manufacturing the liquid-jetting head according to claim 1;

wherein when placing the magnetic member on the base material, the magnetic member is placed to overlap with the entire first region.

4. The method for manufacturing the liquid-jetting head according to claim 3;

wherein the magnetic member is placed on the base material before folding the base material, and the magnetic member is plate-like and has almost the same shape and size as the actuator unit as viewed from the first direction.

5. The method for manufacturing the liquid-jetting head according to claim 1;

wherein when joining the contact points to the individual electrodes, the wiring member is arranged on the actuator unit such that the magnetic member has a protrusion protruding from an outer edge of the actuator unit in a direction parallel to the surface of the flow passage unit, an adhesive is applied between the surface of the flow passage unit and a portion of the base material corresponding to the protrusion, and the wiring member and the flow passage unit are adhered by the adhesive.

6. The method for manufacturing the liquid-jetting head according claim 1;

wherein the drive circuit is fixed on the base material in one of the first region and second region, and the contact points are joined to the individual electrodes with the wiring member placed on the actuator unit such that the entire drive circuit overlaps with the actuator unit in the first direction.

7. The method for manufacturing the liquid-jetting head according to claim 6, further comprising:

placing a heat releasing member, which releases heat generated by the drive circuit, for each of the actuator units on a surface of the drive circuit not facing the actuator unit.

8. The method for manufacturing the liquid-jetting head according to claim 7, further comprising:

placing a biasing member which biases the drive circuit toward the heat releasing member so that the drive circuit and the wiring member are sandwiched between the biasing member and the heat releasing member.

9. The method for manufacturing the liquid-jetting head according to claim 1:

wherein the second region is provided as a plurality of second regions which extend from the first region in a plurality of direction different from each other in a state that the base material is unfolded to be parallel to the surface of the flow passage unit;

wherein the drive circuit is provided as a plurality of drive circuits which are fixed on the second regions respectively; and wherein the method further including connecting a connecting member having a plurality of wires to the second regions after folding the base material to maintain the folded state of the base material.

10. The method for manufacturing the liquid-jetting head according to claim 1;

wherein the base material is folded such that the entire drive circuit overlaps with the magnetic member in the first direction.

11. A liquid-jetting head which jets a liquid, comprising: a flow passage unit in which a plurality of jetting ports from which the liquid is jetted and a plurality of individual, liquid flow passages which are connected to the jetting ports respectively are formed; a plurality of actuator units, which are arranged to be adjacent to each other on a surface of the flow passage unit, each of which includes a plurality of actuators having individual electrodes each corresponding to one of the individual liquid flow passages, and each of which imparts a jetting energy to the liquid in the individual liquid flow passages by driving the actuators; a drive circuit, for each of the actuator units, which supplies drive signals to the actuators; a plurality of wiring members each of which is fixed on one of the actuator units to electrically connect the one of the actuator units and the drive circuit; wherein each of the wiring members includes: a plurality of contact points to be connected to the individual electrodes of the actuators; a plurality of wires connected to the contact points respectively; and a base material on which the contact points and the wires are formed; wherein the base material has a first region in which the plurality of contact points and formed and which faces one actuator unit among the actuator units; and a second region which is different from the first region and in which the contact points are not formed; and wherein the base material is configured such that at least a part of the second region overlaps with another actuator unit adjacent to the one actuator unit in a first direction perpendicular to the surface of the flow passage unit in a state that the base material is unfolded to be parallel to the surface; and a magnetic member arrange on the base material at a position overlapping with the one actuator unit in the first direction.

12. The liquid-jetting head according to claim 11; wherein coefficient of thermal expansion of the magnetic member is closer to that of the surface of the flow passage unit than that of the base material.

13. The liquid-jetting head according to claim 11; wherein the magnetic member overlaps with the entire first region.

14. The liquid-jetting head according to claim 11; wherein the magnetic member has a protrusion protruding from an outer edge of the actuator unit in a direction parallel to the surface of the flow passage unit, and an adhesive is applied between the surface of the flow passage unit and a portion of the base material corresponding to the protrusion to adhere the wiring member aid the flow passage unit.

15. The liquid-jetting head according to claim 11; wherein the drive circuit is fixed on the base material in one of the first region and second region, and arranged in such a position at which the entire drive circuit overlaps with the one actuator unit in the first direction.

16. The liquid-jetting head according to claim 15, further comprising:

a heat releasing member which is arranged on a surface of the drive circuit not facing the one actuator unit to release the heat generated by the drive circuit.

17. The liquid-jetting head according to claim 16, further comprising:

a biasing member which biases the drive circuit toward the heat releasing member and which is arranged so that the drive circuit and the wiring member are sandwiched between the biasing member and the heat releasing member.

18. The liquid-jetting head according to claim 11;

wherein the second region is provided as a plurality of second regions which extend from the first region in a plurality of direction different from each other in a state that the base material is unfolded to be parallel to the surface of the flow passage unit;

wherein the drive circuit is provided as a plurality of drive circuits which are fixed on the second regions respectively; and wherein the liquid-jetting head further includes a plurality of connecting members each of which has a plurality of wires connected to wires formed in the second regions and connects the second regions.

19. The liquid-jetting head according to claim 11; wherein the drive circuit is provided on the second region of the base material and me second region is folded such that the entire drive circuit overlaps with the magnetic member in the first direction.

20. A printer which jets a liquid to a recording paper to record an image, comprising:

a transport mechanism which transports the recording paper; and the liquid-jetting head according to claim 11 which jets the liquid to the recording paper transported by the transport mechanism.

* * * * *

UNITED STATES PATENT AND TRADEMARK OFFICE

CERTIFICATE OF CORRECTION

PATENT NO. : 8,757,763 B2
APPLICATION NO. : 13/294264
DATED : June 24, 2014
INVENTOR(S) : Shuhei Hiwada It is certified that error appears in the above-identified patent and that said Letters Patent is hereby corrected as shown below:

In the Claims

At column 17, claim number 11, line number 56
--"Which the liquid is jetted and a plurality of individual, liquid flow passages"-- should read
--"Which the liquid is jetted and a plurality of individual liquid flow passages"--

At column 18, claim number 19, line number 63
--"material and me second region"-- should read --"material and the second region"--

Signed and Sealed this
Twenty-fifth Day of November, 2014

Michelle K. Lee

Michelle K. Lee
*Deputy Director of the United States Patent and Trademark Office*